US005957823A

United States Patent [19]

Fan

[11] Patent Number: 5,957,823

[45] Date of Patent: Sep. 28, 1999

[54] FOLDING MECHANISM FOR A BAG KNITTING APPARATUS

[76] Inventor: K. S. Fan, No. 73, King Hwa St., San Chung , Taipei, Taiwan

[21] Appl. No.: 09/006,487

[22] Filed: Jan. 13, 1998

[51] Int. Cl.[6] ..... B31B 1/36

[52] U.S. Cl. ..... 493/248; 493/295; 493/302; 493/439

[58] Field of Search ..... 493/244, 248, 493/295, 302, 424, 436, 438, 439, 442, 410, 443; 53/241, 291, 459, 567

[56] References Cited

U.S. PATENT DOCUMENTS

| | | | |
|---|---|---|---|
| 2,701,989 | 2/1955 | Hayward et al. | 493/302 |
| 4,041,849 | 8/1977 | Tsukasaki | 493/436 |
| 4,908,009 | 3/1990 | Yokoyama | 493/295 |
| 4,986,806 | 1/1991 | Braedle et al. | 493/302 |
| 5,024,049 | 6/1991 | Strub et al. | 53/291 |
| 5,246,416 | 9/1993 | Demura et al. | 493/439 |

*Primary Examiner*—John Sipos
*Assistant Examiner*—Steven Jensen
*Attorney, Agent, or Firm*—Bacon & Thomas, PLLC

[57] ABSTRACT

A folding mechanism for a bag knitting apparatus which is intended to fold inwardly the text-printed sides of the double-layer material strip to overcome the problems of conventional bag knitting apparatus. The folding mechanism comprises a clamping roller set, a folding rod set, a supporting set, and a pressing wheel set. The double-layer material strip to be folded is opened to enclose the lower end of the folding rod set such that the sides are positioned between groove surfaces formed on the outer sides of the folding rod set and the pressing wheel set. The material strip is folded as it passes upward between the groove surfaces of the folding rod set and the pressing wheel set.

2 Claims, 4 Drawing Sheets

FOLDING MECHANISM FOR A BAG KNITTING APPARATUS

BACKGROUND OF THE INVENTION

In the conventional process of manufacturing a knitted bag, raw material is firstly knitted into a double-layered material strip which has upper and lower layers and is seamless on both sides. The double-layered material strip is then printed, sealed and cut into pieces, thus forming a knitted bag with two seamless sides.

However, the bottom corners of the knitted bag produced in the above-described way are liable to be broken because they are subjected to the greatest relative heavy loading such that an additional welting operation during the sealing process can not improve their endurance.

To solve the above-mentioned problem, a straightforward method is forming folding on both sides of the material strip and thereafter performing a welting process and the sealing process. In fact, this is the method by which a paper bag's loading ability is enhanced.

However, the knitted bag cannot be folded on both sides as with the paper bag, but requires a further process as follows. As shown in FIG. 4, the double-layer material strip (step A) should be expanded (step B), indented on both sides (step C), and formed into folding (step D). Nevertheless, the commercially available knitted bags have no folding on both sides because the current manufacturing skill is not sufficient to form such folding to increase structural strength.

SUMMARY OF THE INVENTION

The present invention is intended to provide a folding mechanism for a knitted bag which forms folding on both sides of the knitted bag before the sealing operation.

The folding mechanism for a knitted bag according to the present invention comprises a clamping roller set, a folding rod set, a supporting rod set, and a pressing wheel set. The clamping roller set includes two cylindrical rollers arranged at a bottom side of the folding mechanism. Each roller is spaced a predetermined distance from the other and has an axis which is parallel to the other. The folding rod set includes two perpendicular folding rods and a supporting shaft keeping a constant separation between the folding rods. The folding rods each have a tapered shape such that they have a narrower lower end and a wider upper end. Each folding rod has an outer side formed as a concave guiding groove surface. The supporting rod set includes a pair of lateral rods arranged horizontally at a front side and a back side of the folding rod set and a pair of longitudinal rods arranged at the outer sides, respectively, of the folding rod set. The pressing wheel set includes a pair of disk-shaped pressing wheels arranged at the upper side and the lower side, respectively, of each longitudinal rod. Each pressing wheel has a rim positioned adjacent the concave guiding groove surface at the outer side of the respective folding rod. In operation, the material strip with back and front sides is opened to enclose the lower ends of the folding rod set. Here, the sides of the material strip are positioned between the concave guiding groove surfaces and the respective pressing wheels as the material strip is passed thereby so that both sides of the material strip are folded by the pressing wheels.

BRIEF DESCRIPTION OF THE DRAWINGS

In order to better understand the present invention, reference should be made to the following detailed description taken in junction with the accompanying drawings, wherein.

DETAILED DESCRIPTION OF THE PREFERRED EMBODIMENT

Figure 1:
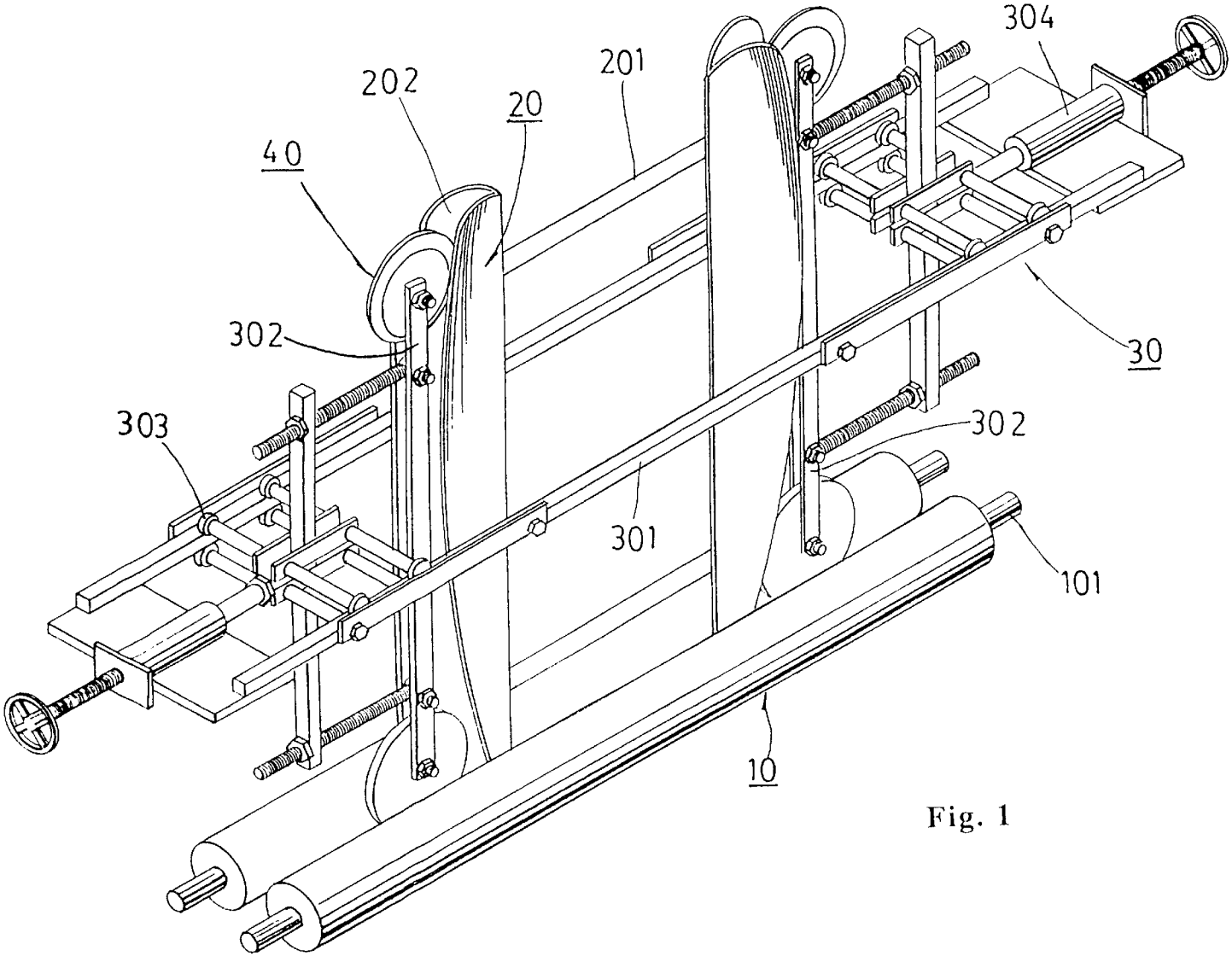
FIG. 1 shows a perspective view of the present invention.
Figure 2:
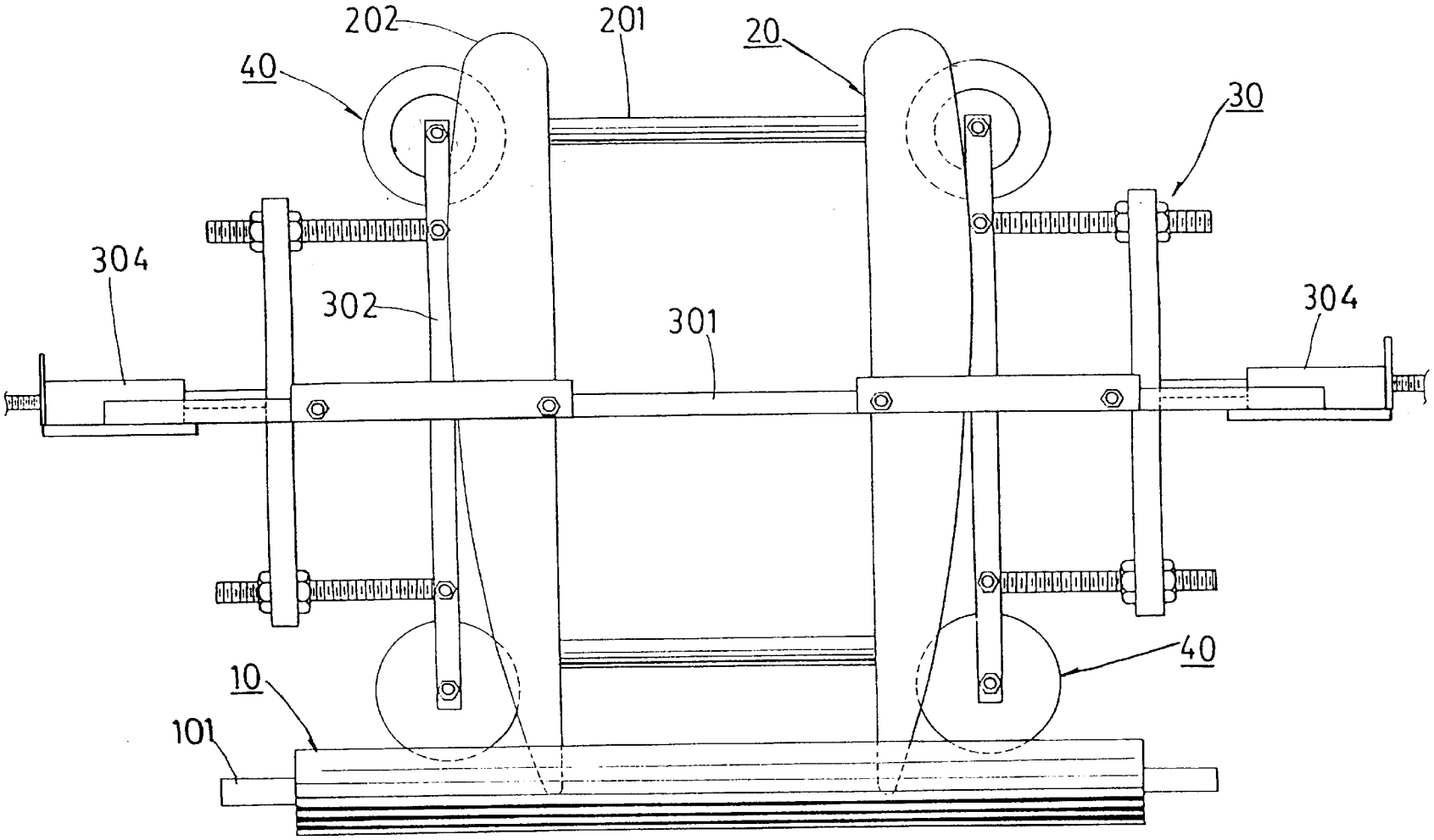
FIG. 2 shows a front view of the present invention.
Figure 3:
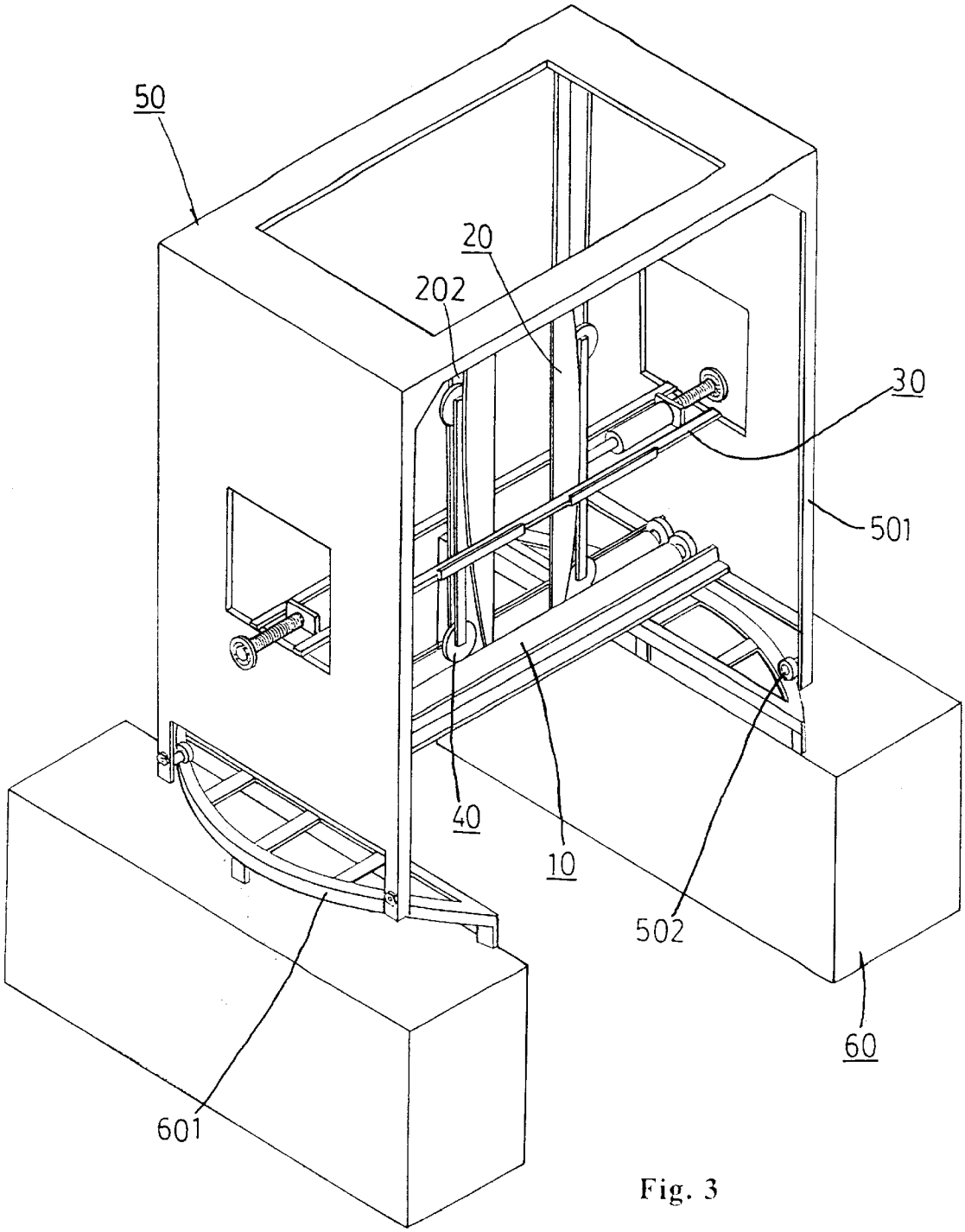
FIG. 3 shows a preferred embodiment of the present invention.
Figure 4:
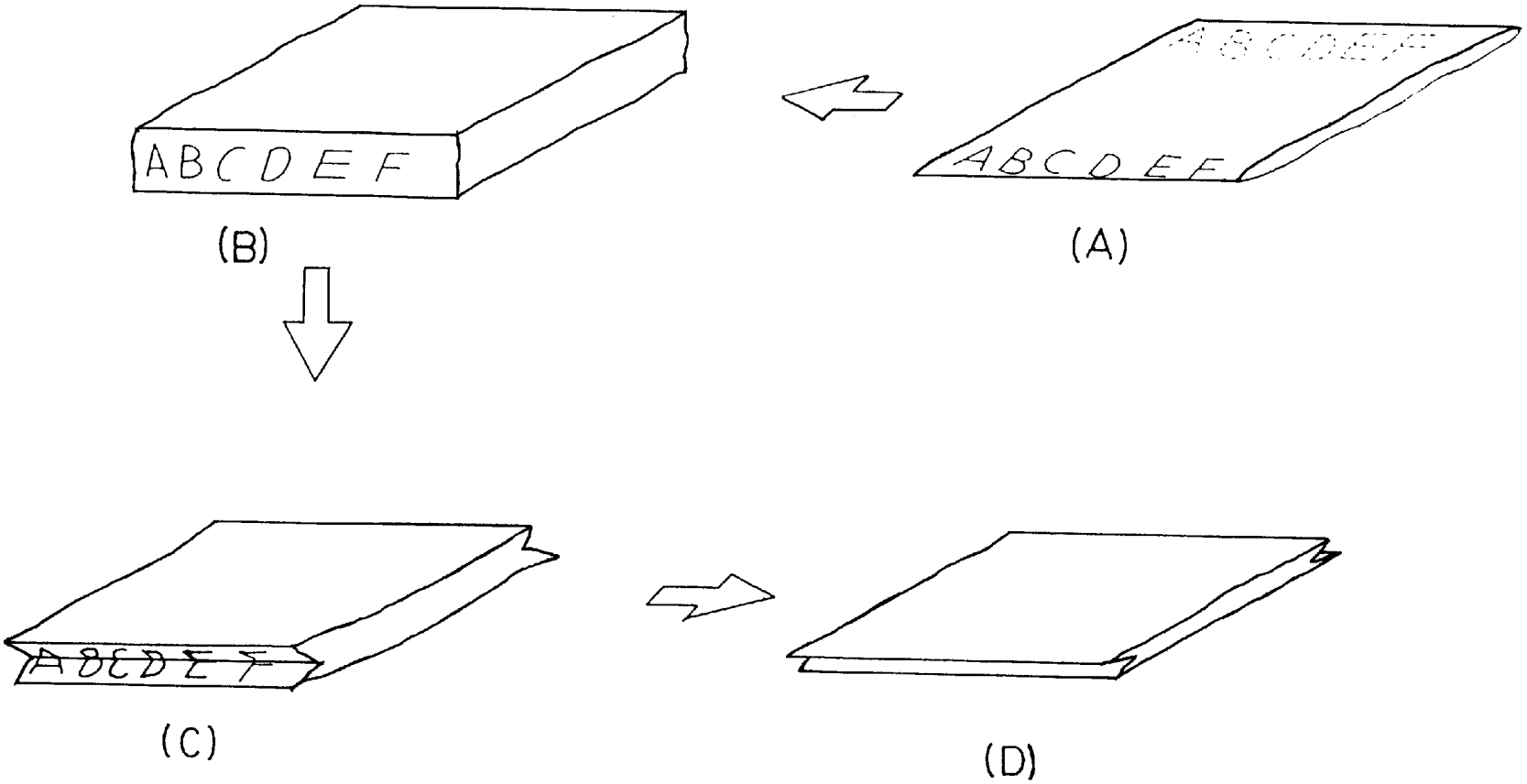
FIG. 4 is a flowchart of the process of forming folding in a knitted bag.

As shown in FIGS. 2 and 3, the folding mechanism for a bag knitting apparatus according to the present invention comprises a clamping roller set (10), a folding rod set (20), a supporting rod set (30), and a pressing wheel set (40). The clamping roller set (10) includes two cylindrical rollers arranged at a bottom side of the folding mechanism. Each roller is spaced a predetermined distance from each other and has an axis (10) which is parallel to the other. The folding rod set (20) includes two perpendicular folding rods and a supporting shaft (201) keeping a constant separation between the folding rods. The folding rods each have a tapered shape such that they have a narrower lower end, which can be inserted into the gap formed between the clamping roller set (10), and a wider upper end, which can prevent the folding rod set (20) from dropping out of the clamping roller set (10). Each folding rod has an outer side formed as a concave guiding groove surface (202). The supporting rod set (30) includes a pair of lateral rods (301) arranged horizontally at a front side and a back side of the folding rod set (20), to prevent the folding rod set (20) from moving forward or backward, and a pair of longitudinal rods (302) arranged at the outer sides of the folding rod set (20). Moreover, the longitudinal rods (302) are connected to the lateral rods (301) through a pulley (303) and can adjust the distance between the longitudinal rods (302) and the folding rod set (20) by a pneumatic or hydraulic mechanism. The pressing wheel set (40) includes a pair of disk-shaped pressing wheels arranged at the upper side and the lower side, respectively, of each longitudinal rod (302). Each pressing wheel has a rim positioned adjacent the concave guiding groove surface (202) at the outer side of the respective folding rod.

In operation, the material strip with back and front sides is opened to enclose the lower ends of the folding rods. Here, the sides of the material strip are positioned between the concave guiding groove surfaces (202) and the respective pressing wheels (40) with the back and front surfaces of the material strip being placed between the folding rod set (20) and the clamping roller (10). As the material strip is passed upward, the folding rod set (20) is not affected by the movement of material strip because of its weight, while both sides of the material strip are folded inwardly by the pressing wheels (40). The material strip will thereby have folding on both sides after passing the folding rod set (20) and the pressing wheels (40). Then the material strip may be subjected to a sealing operation to form a knitted bag with folded sides.

As shown in FIG. 3, the folding mechanism for a bag knitting apparatus according to the present invention comprising a clamping roller set (10), a folding rod set (20), a supporting rod set (30), and a pressing wheel set (40) may be installed on a frame (50). A bottom of each leg (501) of the frame (50) is provided with a pulley (502) by which they are moveably mounted upon an arcuate track (601) on a base (60), thus allowing rotation of the frame (50) with respect to the base (60). By above arrangement, the folding mechanism can shift the material strip. More specifically, the material strip, after being printed, requires a shift operation to adjust its printed graph on the center of the back/front surface. The rotation of frame (50) upon the base (60) adjusts the direction of the material, such that the orientation of the folding operation is shifted accordingly.

To sum up, the folding mechanism according to the present invention folds the material strip automatically to produce a knitted bag with better structural strength.

While this invention has been described in connection with what is presently considered to be the most practical and preferred embodiment, it is to be understood that the invention is not limited to the disclosed embodiment and has various modifications. Therefore the present invention is intended to cover various modifications and equivalent arrangements included within the spirit and scope of the appended claims.

What is claimed is:

1. A folding mechanism for a bag knitting apparatus, wherein the folding mechanism is arranged vertically with a top and a bottom, where a strip of material moves upwardly through the folding mechanism comprising:

a clamping roller set including two rollers arranged at the bottom of the folding mechanism, each roller having an axis parallel to the other, each roller being spaced a predetermined distance from the other;

a folding rod set including two folding rods arranged perpendicular to the clamping roller set, each folding rod having an upper end and a lower end and a supporting shaft keeping a constant separation between the folding rods, each folding rod having a tapered shape such that the lower end is relatively narrowere than the upper end, each folding rod having an inner side located nearest the other folding rod and an outer side formed as a concave guiding groove surface;

a supporting rod set including a pair of lateral rods arranged on both sides, of the folding rod set and a pair of longitudinal rods arranged at the outer sides, respectively, of the folding rod set; and a pressing wheel set including a pair of disk-shaped pressing wheels arranged at the upper end and the lower end, respectively, of each longitudinal rod, each pressing wheel having a rim positioned adjacent the concave guiding groove surface at the outer side of the respective folding rod;

wherein both sides of the material strip are folded by the pressing wheels when the material strip is opened to enclose the lower ends of the folding rods and passed with the sides of the material strip positioned between the concave guiding groove surfaces and the respective pressing wheels.

2. A folding mechanism according to claim 1, further comprising:

a frame upon which the folding mechanism is installed, the frame having a plurality of legs; and a base having an arcuate track upon which the legs of the frame are movably mounted such that the folding mechanism is rotatable with respect to the base.

* * * * *